US005806675A

United States Patent [19]

Kim

[11] Patent Number: 5,806,675

[45] **Date of Patent: *Sep. 15, 1998**

[54] STABILIZATION SLEEVE FOR GOLF BAG WITH FULL LENGTH DIVIDER

[76] Inventor: Jin C. Kim, 8161 8th St., No. 6, Buena Park, Calif. 90621

[ * ] Notice: The term of this patent shall not extend beyond the expiration date of Pat. No. 5,573,112.

[21] Appl. No.: 705,815

[22] Filed: Aug. 30, 1996

[51] Int. Cl.[6] ..... A63B 55/00

[52] U.S. Cl. ..... 206/315.6; 206/315.3

[58] Field of Search ..... 206/315.3–315.6, 206/315.8

[56] References Cited

U.S. PATENT DOCUMENTS

| | | | |
|---|---|---|---|
| 1,227,657 | 5/1917 | Pierce | 206/315.6 |
| 1,726,245 | 8/1929 | Shelton | 206/315.6 X |
| 1,788,478 | 1/1931 | Beaty et al. | 206/315.6 |
| 1,798,638 | 3/1931 | Stone et al. | 206/315.6 |
| 1,809,536 | 6/1931 | Tucker | 206/315.6 |
| 1,840,183 | 1/1932 | Blich | 206/315.6 |
| 2,023,792 | 12/1935 | Sampson | 206/315.6 X |
| 2,256,521 | 9/1941 | Kirkpatrick et al. | 206/315.3 |
| 2,294,084 | 8/1942 | Gihon, III et al. | 206/315.6 |
| 2,546,416 | 3/1951 | Alter et al. | 206/315.6 |
| 2,568,810 | 9/1951 | Kish, Jr. . | |
| 2,752,973 | 7/1956 | Stamp | 206/315.6 |
| 3,455,358 | 7/1969 | Kuzma | 206/315.6 |
| 3,729,036 | 4/1973 | McFadden | 206/315.6 |
| 4,172,484 | 10/1979 | Henning | 206/315.6 |
| 4,311,178 | 1/1982 | Kennedy . | |
| 4,691,823 | 9/1987 | Pape | 206/315.6 |
| 4,709,814 | 12/1987 | Antonious | 206/315.6 X |
| 4,911,292 | 3/1990 | Airey, Jr. | 206/315.3 |
| 5,103,974 | 4/1992 | Antonious | 206/315.6 |
| 5,148,915 | 9/1992 | Ryan | 206/315.6 |
| 5,226,533 | 7/1993 | Antonious | 206/315.6 |
| 5,255,781 | 10/1993 | Dulyea, Sr. | 206/315.6 |
| 5,279,414 | 1/1994 | Brasher | 206/315.6 |
| 5,392,907 | 2/1995 | Blanchard et al. | 206/315.6 |
| 5,402,883 | 4/1995 | Shin | 206/315.6 X |
| 5,447,228 | 9/1995 | Hodgson, III | 206/315.6 X |
| 5,505,300 | 4/1996 | Joh | 206/315.6 |
| 5,573,112 | 11/1996 | Kim | 206/315.6 |

FOREIGN PATENT DOCUMENTS

| | | | |
|---|---|---|---|
| 216273 | 10/1955 | Australia | 206/315.3 |
| 428118 | 8/1911 | France | 206/315.5 |
| 1479 | 12/1905 | United Kingdom | 206/315.5 |
| 8333 | 2/1911 | United Kingdom | 206/315.5 |
| 3493310 | 5/1931 | United Kingdom | 206/315.5 |
| 705115 | 3/1954 | United Kingdom | 206/315.5 |
| 2130102 | 5/1984 | United Kingdom | 206/315.6 |

OTHER PUBLICATIONS

"Golf Shop Operations", a Golf Digest Publication, Apr. 1990, Organizer on p. 124 sold by QS.

*Primary Examiner*—Sue A. Weaver
*Attorney, Agent, or Firm*—Curtis L. Harrington

[57] ABSTRACT

The golf bag of the present invention uses an insert formed of an outer portion including a plurality of serpentine mounted, looped compartments which helps circumferentially distribute the load from the weight of the clubs about the internal periphery of the golf bag, and which continue to the bottom of the golf bag as full length dividers. The inventive sleeve which surrounds and is attached to the outer periphery of the lower rim of the insert holds the insert in a taught position so that clubs carried by and removed from the insert will not bind and will be easily removable from the golf bag which carries the insert.

6 Claims, 6 Drawing Sheets

Fig. 3
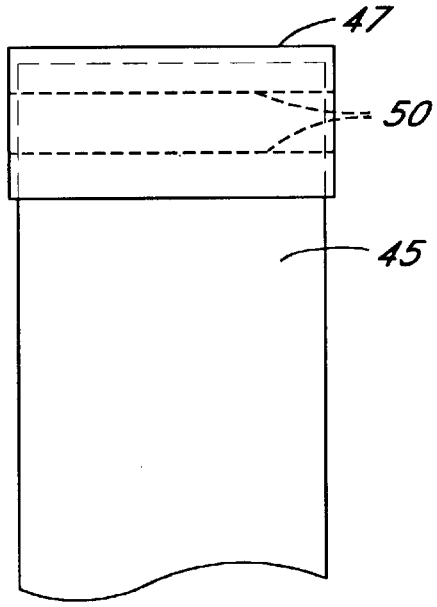
Fig. 4
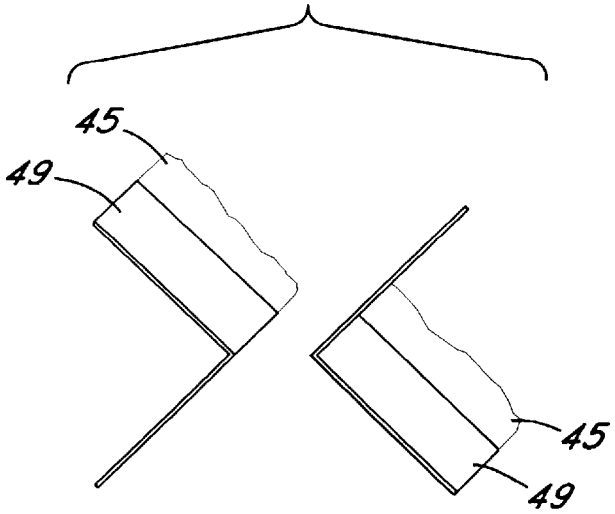
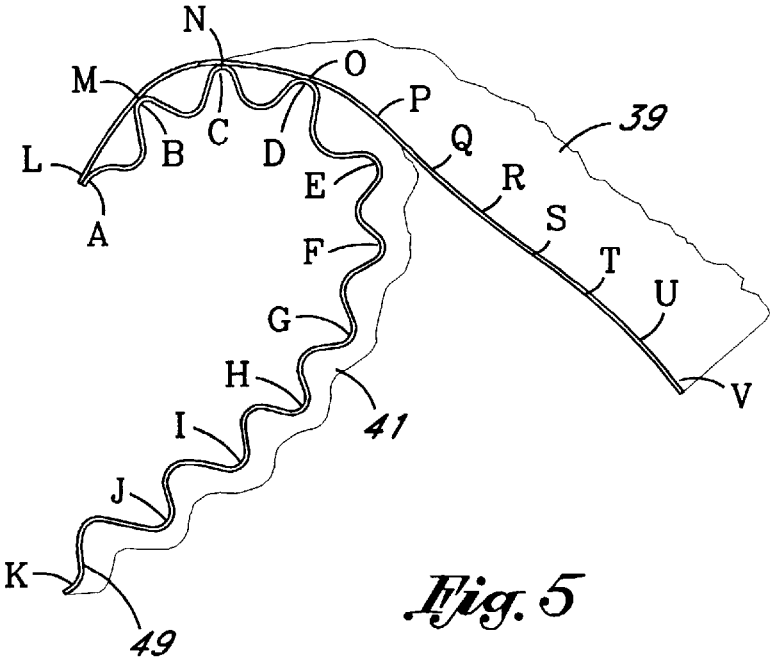
Fig. 5

STABILIZATION SLEEVE FOR GOLF BAG WITH FULL LENGTH DIVIDER

FIELD OF THE INVENTION

The present invention relates to the field of sporting goods and equipment. More specifically, the present invention relates to a golf bag and method of stabilizing a group of separate, full length dividers which sub-divide the internal central containment area of the golf bag into individual compartments which extend the full length of the golf bag.

BACKGROUND OF THE INVENTION

Conventional golf bags have a central containment volume in the form of an elongate cylindrical space. Typically the top or entrance of the golf bag may be reinforced with structures tending to divide only the entrance of the contained volume. While a subdivision of the entrance of the golf bag helps to protect the club heads to a degree, the club shafts within the bag are free to bump and scratch each other. Further, the extent of the subdivision of the space at the entrance of the golf bag is typically limited to three or six openings. This number does not provide even separation of the clubs, which must be stored at least two per opening. The opening subdivision structure also tends to have thick dividing members which restrict the entrance opening into the golf bag. Consequently a larger number of subdivided spaces equates to a lesser overall opening space into the golf bag.

One bag which has been on the market has enabled a subdivision of the spaces of a golf bag from the entrance to the bottom. This bag has been originally commercially available by Cal Malibu, Inc. and sold under the trademark name CROSPETE®. The pattern involves looping side pockets, with the central space defined by the outer portion of the side pockets subdivided by an "X" divider. The upper two or three inches of the divided space is stiffened, giving way to soft material extending toward the bottom of the golf bag. Each space formed within the CROSPETE® bag is individual, extending all the way to the bottom of the bag.

The CROSPETE® bag has 10 small storage spaces about the inner periphery of the bag in combination with four central storage spaces created by the "X" shaped divider which divides the remaining space. The advantages of providing individual spaces include the preservation of the golf clubs. The even dispersion of the spaces within the golf bag prevents the clubs from bunching at one side of the bag or the other. For golfers who carry their bags, the prevention of bunching can assist the golfer in carrying the bag.

The main problem has been the internally located dividers. The dividers are made of a fabric material of extremely light weight. The bottom of the divider cannot be sewn shut as it would not withstand the weight of the clubs dropped about one club length into the bag. Another method used involved long metal rods attached to the fabric at the bottom of the divider material to hold the bottom end of the dividers at the bottom. The rods were bent into a loop engaging a rivet at the bottom of the material, and the rivets were punched through the material at the material's outer periphery.

This caused a periodic unexpected bunching together of the material at the bottom of the divider section when the tip end of a club would pull some of the material upward. Continued pulling upward on the material caused the ends of the metal rods to come together to further grasp the material at the bottom of the divider. The result was golf clubs which were so forcefully grasped by the divider material that they could not be removed from the bag. This problem, even if occurring periodically, is such that the bag itself is rendered useless. In addition, the metal rods collectively contributed to the weight of the bag.

Other solutions involved the use of a circular sheet of rigid material sewn to the periphery of the bottom of the divider material. Although this technique helped to prevent the binding closure about the end of a golf club, it failed to prevent the catching of the clubs at the bottom of the divider material causing the bottom of the dividers, as well as the circular sheet of rigid material to be drawn upwardly.

One short term solution was the addition of glue or hook and loop members between the bottom of the circular sheet of rigid material and the bottom of the bag. This was found to work only when the magnitude of force from catching the club is less than the holding force of either the glue or the hook and loop members. Over time, the glue weakens, and repeated upward force can cause the hook and loop members to become disengaged.

What is therefore needed is a method to hold divider material in place, and particularly from a circular support vantage point. This is especially true for the CROSPETE® bag where the greater number of dividers have contact with the outer periphery of the divider section.

SUMMARY OF THE INVENTION

The golf bag of the present invention uses an insert formed of an outer portion including a plurality of serpentine mounted, looped compartments which helps circumferentially distribute the load from the weight of the clubs about the internal periphery of the golf bag, and which continue to the bottom of the golf bag as full length dividers. The inventive sleeve which surrounds and is attached to the outer periphery of the lower rim of the insert holds the insert in a taught position so that clubs carried by and removed from the insert will not bind and will be easily removable from the golf bag which carries the insert.

BRIEF DESCRIPTION OF THE DRAWINGS

The invention, its configuration, construction, and operation will be best further described in the following detailed description, taken in conjunction with the accompanying drawings in which:

FIG. 3 illustrates the strengthening of the upper edge of material to be used in a full length divider by the addition of a reinforcing strip;

FIG. 4 illustrates the joinder of two lengths of material which will form the inner divider;

FIG. 5 illustrates the beginning of the formation of the interior of the golf bag as the first of the two outer lengths of material begin to be formed;

DETAILED DESCRIPTION OF THE PREFERRED EMBODIMENT

Figure 1:
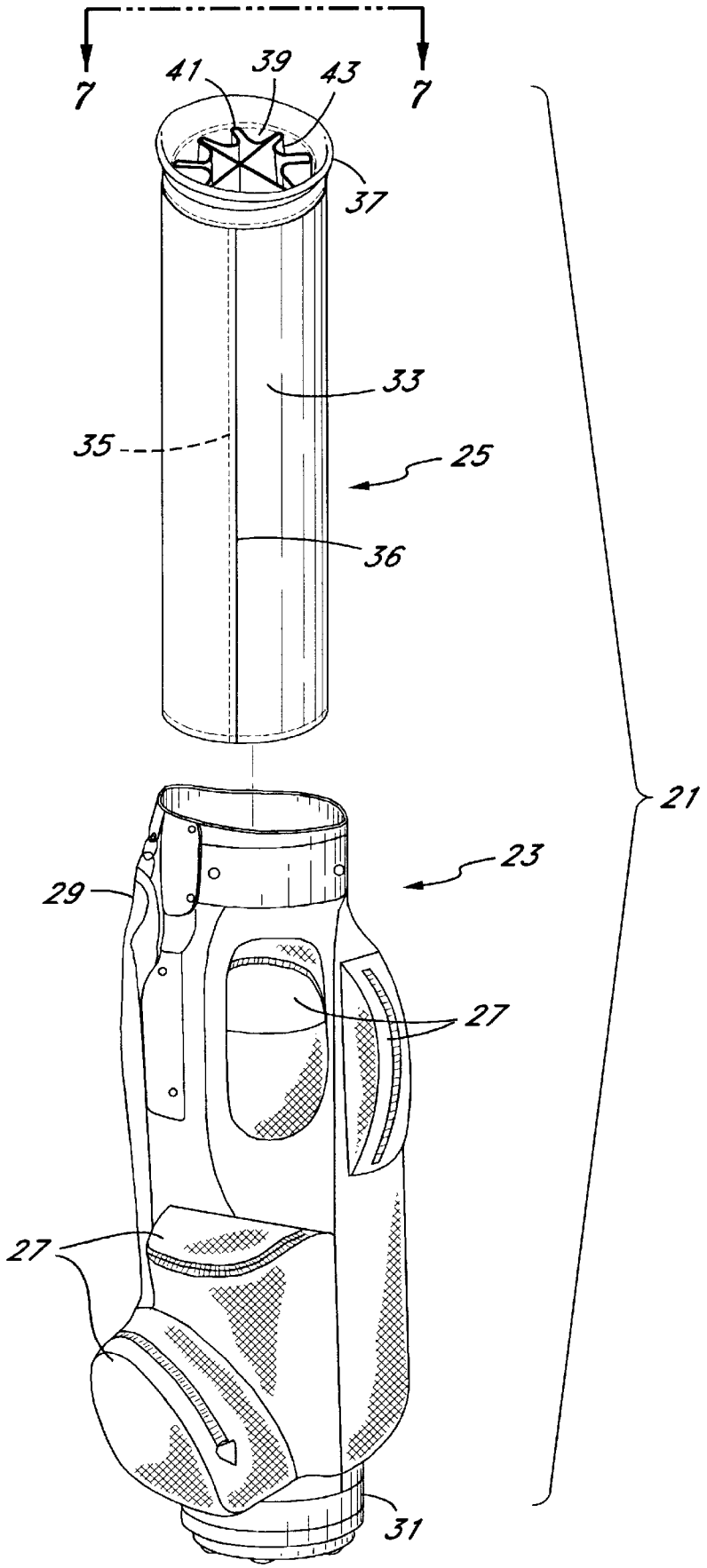
FIG. 1 is a perspective exploded view of the golf bag of the present invention shown with a typical golf bag exterior into which the interior fits.

The description and operation of the invention will be best described with reference to FIG. 1. FIG. 1 is an exploded view of the golf bag 21 of the present invention which generally includes an outer portion 23 and an inner portion or full insert 25. The golf bag housing or outer portion 23 is a shell which may be formed in a conventional manner. The outer portion 23 has various compartments 27, as well as a carrying strap 29. The compartments 27 are typically closable as by zippers, snaps, and the like. The compartments 27 are typically used to carry extra towels, golf balls and tees. The outer portion 23 also may have a base 31 which may have structures to protect the bag 21 when it is placed on the ground.

The full insert 25 includes an outer relatively rigid covering portion or support sleeve 33 which includes a vertical length of stitching 35, adjacent an exposed edge 36 of the sleeve 33. The stitching 35 helps to form the covering portion 33 into a cylinder. Stitching 35 is shown in dashed line format, as is all stitching the drawings whether identified by number or not.

The upper part of the full insert 25 includes a thickened rim 37 and an upper shape which is suitable to interfit with the golf bag outer portion 23. The full insert 25 is configured to fit within the outer portion 23 and may be held therein by a combination of glue or a strap from the outer portion 23 which secures the full insert 25.

Inside the full insert 25, a shape having a series of looping pockets about the inner periphery of the upper portion 25 and separated by a central cross or "X" shaped divider is shown. The looping pockets are formed between an outer layer of material 39 and an inner looping layer of material 41. An inner divider 43 is made up of two sheets of material sewn along their respective center lines.

Figure 2:
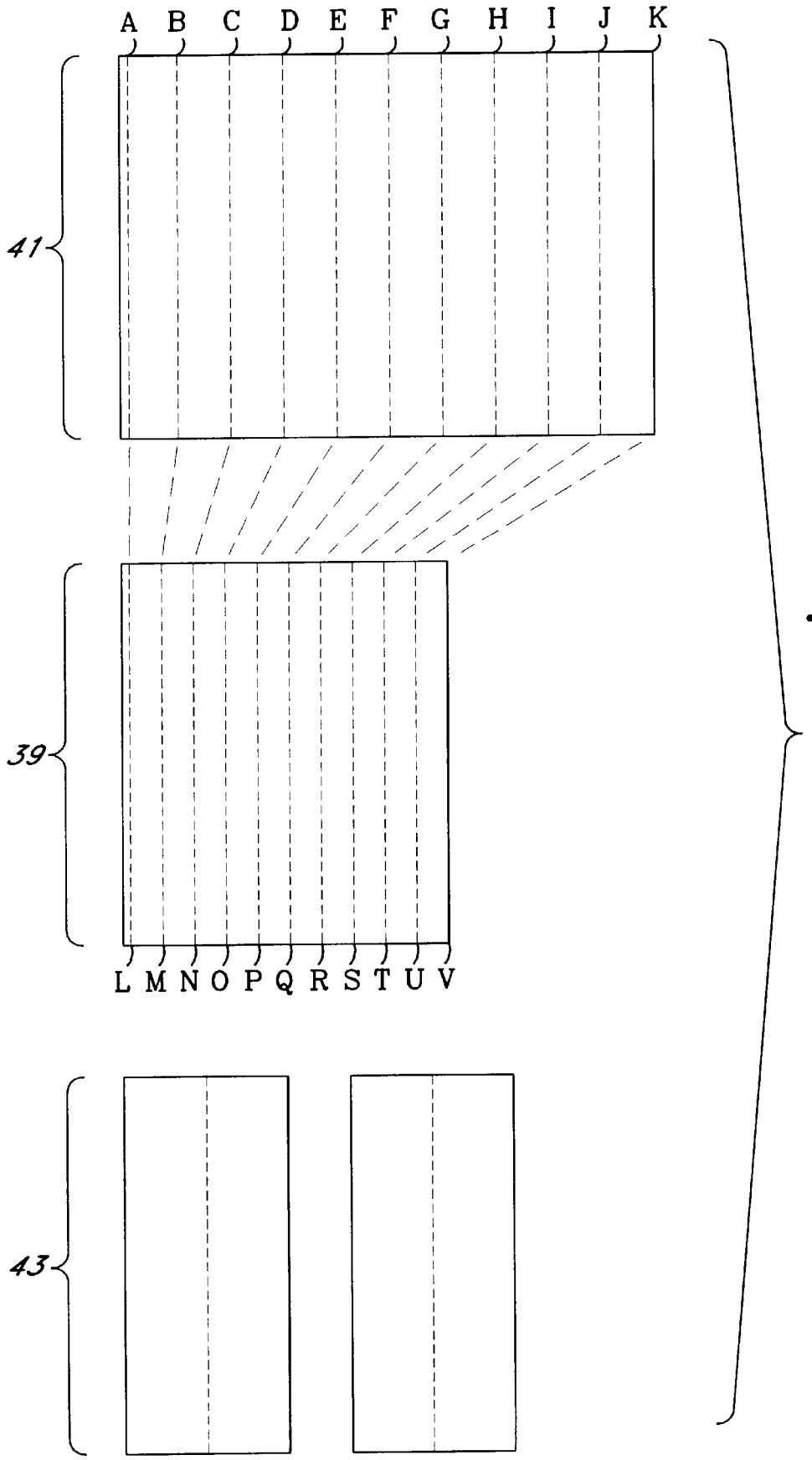
FIG. 2 illustrates the four sheets of material from which the interior of the golf bag shown in FIG. 1 is made.

Referring to FIG. 2, the material making up the covering portion 33 is absent, and the outer layer of material 39, inner looping layer of material 41 and inner divider 43 is shown in somewhat schematic form to illustrate the manner of assembly. The inner looping length of material 41 have a series of evenly distributed seams A, B, C, D, E, F, G, H, I, J, and K which will connect with the outer layer of material 39 along a matching, but more closely series of evenly distributed seams L, M, N, O, P, Q, R, S, T, U, and V, respectively. Because inner looping layer of material 41 is of the same length, but of greater width, the connection along the seams A, B, C, D, E, F, G, H, I, J, and K will result in a series of looped pockets. When the outer layer of material 39 is formed into a tube with the looped pockets pointing internally, the peripheral pocket shape seen in FIG. 1 will result.

In addition, the divider 43 is made up of a first length of material 45 and a second length of material 47. When the seams of material 45 and 47 are joined, a resulting structure having an "X" cross section results. Once the materials 45 and 47 are joined, the outer layer of material 39 can begin to be joined to the inner looping layer of material 41. If construction proceeds in this order, a single sewn seam can be used to join one of the outside edges of the divider 43 to the inner looping layer of material 41 as it is being attached to the outer layer of material 39. This eliminates the need to perform two sewing activities as the inner most structures of the full insert 25 is being formed.

Referring to FIG. 3 a schematic view of any one of the lengths of material, in this case length of material 45 is shown as being fitted with a reinforcing strip 49. Typically, the reinforcing strip 49 will be doubled across the end of the end of a length of material 45 and sewn with a pair of stitches 50 to sandwich the reinforcing strip 49 about the end of the length of material 45.

The reinforcing material 49 may be felt or corduroy. The purpose of the reinforcing material 49 is twofold. First, it provides some stiffening and reinforcing influence on the top of the divider group. Secondly, it can provide a finishing layer which will give an improved appearance.

Referring to FIG. 4, an exploded perspective view of the end portions of the divider 43 formed by the lengths of material 45 and 47 are shown. Ideally, the lengths of material 45, and 47 will be sewn together with the reinforcing material 49 in place.

Referring to FIG. 5, an end schematic view is shown illustrating the sewn joinder of outer layer of material 39 to inner looping layer of material 41. In FIG. 5, the divider 43 is not shown, only for clarity, since it is expected that the outer edges of the divider 43 will be assembled along with the materials 39 and 41.

Seams A, B, C, D, E, F, G, H, I, J, and K are shown as the lower valleys of each formed loop pocket and which are sewn to seams L, M, N, O, P, Q, R, S, T, U, and V, respectively. Seen on inner looping layer of material 41 is the reinforcing strip 49. Where a reinforced collar is to be used, the outer layer of material 39 does not require a reinforcing strip 49.

Figure 6:
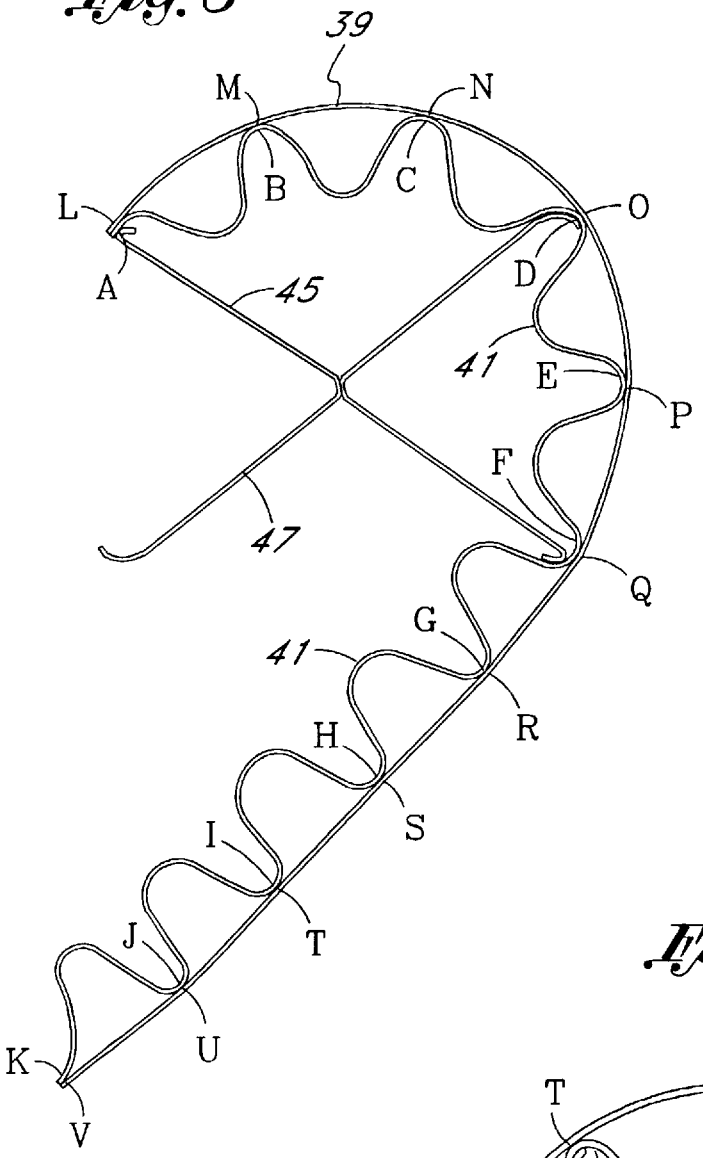
FIG. 6 illustrates the further stages of formation of the interior of the golf bag as the first two lengths of material as shown in FIG. 4 is joined to the two outer lengths of material shown in FIG. 3.

Referring to FIG. 6, an end view which omits the explicit showing of the reinforcing strips 49 can better illustrate the order of joining of the materials 39, 41 and divider 43. The seam "A" at the end of inner looping layer of material 41 and the seam "L" at the end of outer layer of material 39 are shown as sewn to the material 45 near its edge. A small bit of material at the edge is left free and is show somewhat folded inward.

In actual practice the first seams "A" and "L" need not be joined with the divider 43 especially where the end edges of the outer layer of material 39 and inner looping layer of material 41 will have to be overlapped with the other end edge of materials 39 and 41 in order to form a complete tube. However, with the configuration thus started, seams "D" and "O" are joined to the other edge of the length of material 45. Joinder with the edges of the length of material 47 also will occur at seams "F" and "Q", and at seams "V" and "K".

Figure 7:
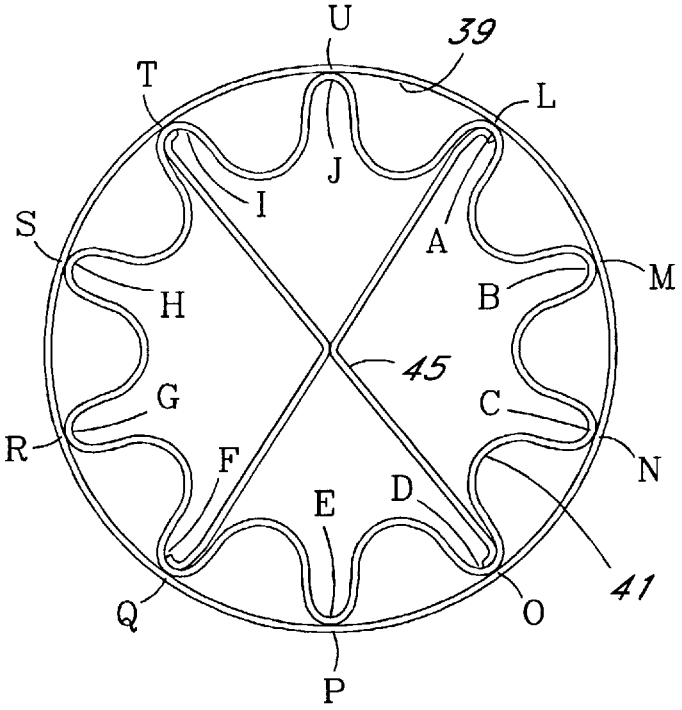
FIG. 7 is an end view of the completed divider formed as shown in FIGS. 3–6.

Referring to FIG. 7, an end view of the completed structure formed by the steps shown in FIGS. 4–6 is illustrated. The resulting structure has a symmetrical appearance and 10 loop pockets surrounding the inner periphery of the outer layer of material 39. Each space between each of the structural materials of FIG. 7 represent a full length space which can support an individual golf club or implement. Before the further structures, especially the sleeve 33 were added, the structure shown in FIG. 7 had experienced problems in freely enabling the golf clubs and implements from being easily withdrawn from each of the spaces shown in FIG. 7. As will be seen, the manner of attachment of the sleeve 33 has alleviated these problems.

Figure 8:
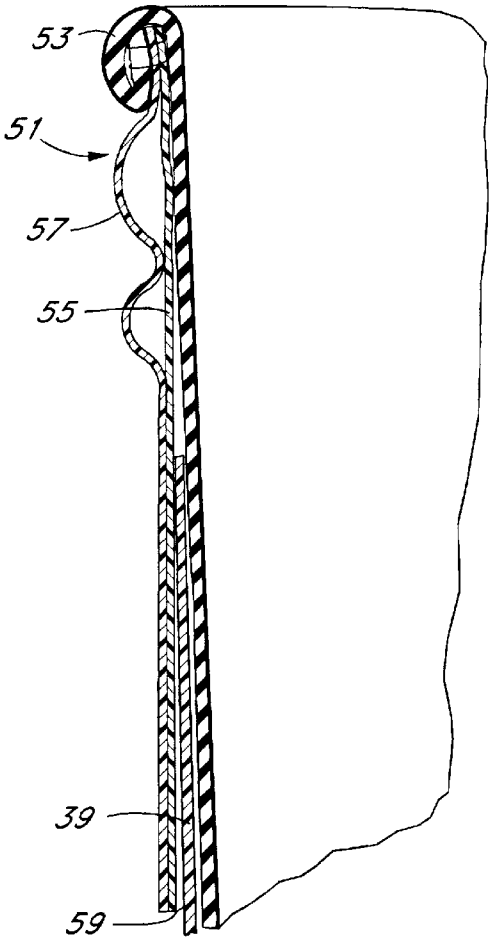
FIG. 8 is a side sectional view of a collar of the internal portion or divider portion of the golf bag of the present invention.

Referring to FIG. 8, the formation of a collar 51 for the full insert 25 and which sits at the top of the full insert 25 is shown. The collar 51 is made up of three layers of material. These materials have an area of expanse, although the term length will be used for simplicity. As can be seen in the Figures, the area of expanse must be sufficient to cover the inside and a part of the outside of the full insert 25. A well-finished, rubber backed material 53 is sewn and arranged to be folded over the line of joinder of the three materials to form a soft, attractive rim. A second length of material 55 is made of relatively thin, relatively rigid material, such as polyvinyl chloride. This material will support being sewn to the divider structures previously shown in FIGS. 1–7.

Between the rubber backed material 53 and the inner second length of material 55 is a length of ring accommodating material 57.

As can be seen, rubber backed material 53 is oriented such that the rubberized side faces and is joined to ring accommodating material 57. This enables the rubber backed material 53 to be brought upward and around the seam where it is joined to materials 55 and 57 and down along side the inside of material 55 to expose the finished surface and to hide the rubber backing completely.

The length of ring accommodating material 57 has a gentle groove along its length which will accommodate a welded ring between the ring accommodating material 57 and the second length of material 55.

The upper edge of the outer material 39 will be captured within the rubber backed material 53 and the second length of material 55 which is preferably a somewhat rigid layer. The rubber backed material 53 is folded within to provide a finished surface to complement the finished surfaces of the reinforcing material 49 which was attached to the inner looping layer of material 41 before further assembly. Note that the bottom of the second length of material 55 has a lower abutment surface 59.

Figure 9:
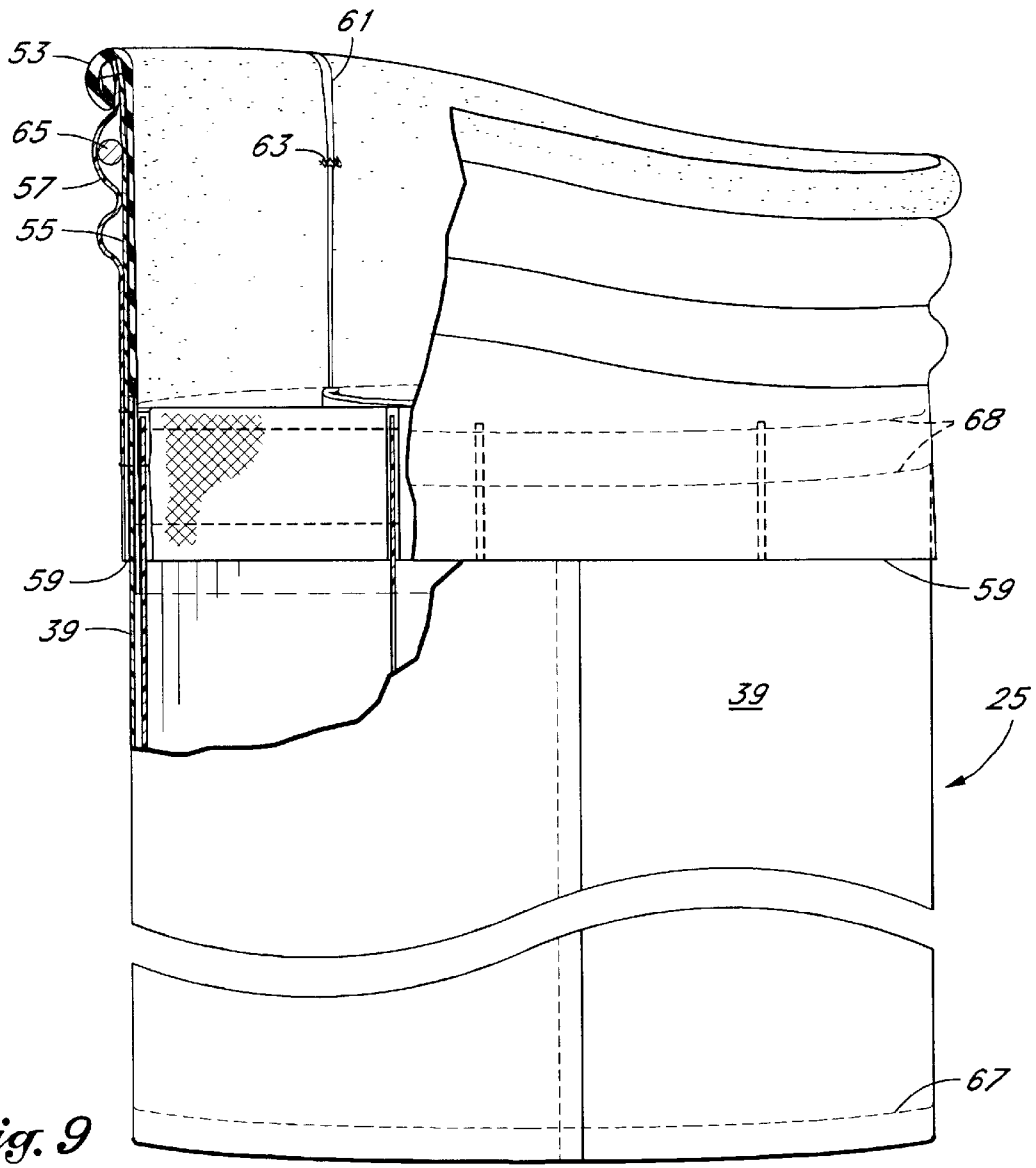
FIG. 9 is a semi-sectional view of the collar in place atop the full length divider shown in FIGS. 3–7.

Referring to FIG. 9, the collar 51 is shown in place atop the assembled internal portion of the full insert 25. The outer surface of the outer layer of material 39 is seen and partially covered by the second length of material 55, and to the extent of the lower abutment surface 59. There is a broken portion showing that the actual length of the full insert 25 is longer than is shown in FIG. 9. Also seen is a separation portion 61 where the collar 51 is joined together by a horizontal spot stitch 63. Also shown is a ring 65 which is used to strengthen the upper portion of the full insert 25.

At the lower end of the outer layer of material 39 full insert 25 shown in FIG. 9, a horizontal stitch line 67 is seen with which the sleeve 33 will be joined to the outer layer of material 39.

The ring 65 is typically about one fourth of an inch in diameter and may have welded ends rather than to be formed of a single length of material. The ring 65 rests against the second length of material 55 and within the groove in the softer length of ring accommodating material 57. The groove enables the ring 65 to be retained in place, especially once the full insert 25 is brought to rest within the outer portion 23, to create clamping forces on the upper part of the full insert 25. The structures are secured with a pair of horizontal stitches 68.

Figure 10:
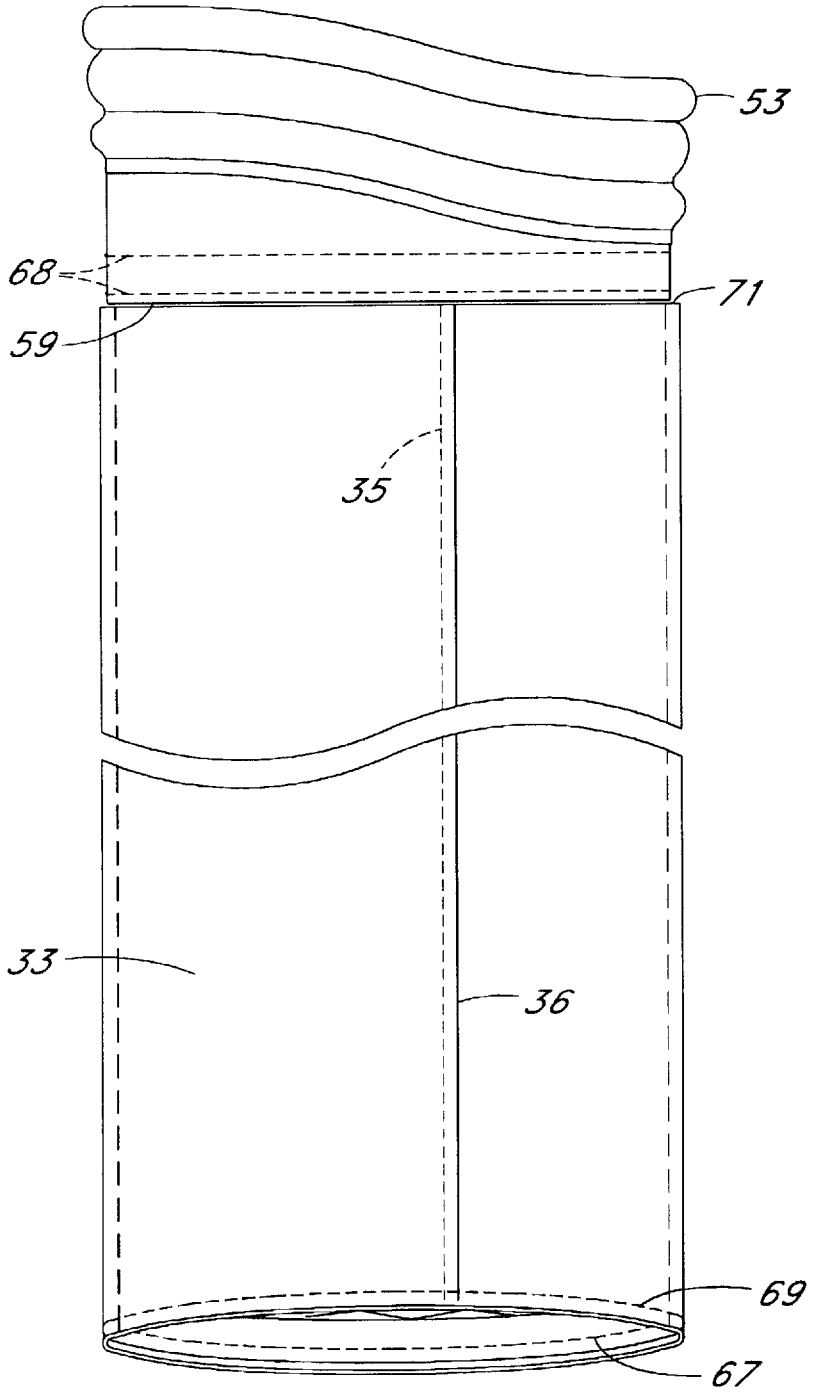
FIG. 10 illustrates a side view of the completed internal portion shown in FIG. 1.

Once the structure shown in FIG. 9 is formed, it has no rigid covering portion or sleeve 33 as was shown in FIG. 1. Referring to FIG. 10, the rigid sleeve 33 should preferably be made of a relatively thin layer of polyvinyl chloride. A length of such material is readily made into a cylinder by the use of the elongate stitch 35.

Note the presence of an elongate stitch 69 which is made simultaneously with the elongate stitch 67. The stitches 67 and 69 act to hold completely open the bottom periphery of the outer layer of material 39. Once the sleeve 33 is made into a cylinder, the stitches 67 and 69 stabilize the bottom of the internal part of the full insert 25. As such, and since it is being held open, it will not allow any portion of any of the materials 45, 47, or 41 to bunch or pinch to hold a golf club or other implement within the full insert 25.

Ideally the diameter of the covering portion 33 will somewhat match the diameter of the second length of material 55 so that neither one will jam into the other. The covering portion 33 is attached to the outer layer 39 adjacent the bottom edge of the sleeve 33. The sleeve 33 has an upper abutment surface 71 which abuts the lower abutment surface 59 of the second layer 55. From abutment surface 71 to 59, the connection through the mechanical portions of the full insert 25 and collar 51 are slightly loose, such that covering portion 33 will be able to rotate about one fourth of an inch or less with respect to the second length of material 55.

Preferably, the length of the outer layer of material 39 will be slightly less in length than the length of the divider material 45 and 47, and the inner looping layer of material 41. This enables further sewing of the outer layer of material 39 to the lower end of the sleeve 33.

While the present invention has been described in terms of a golf bag, and in terms of the use of a stabilizing external sleeve to solve a problem with a full length divider, one skilled in the art will realize that the structure and techniques of the present invention can be applied to many appliances. The present invention may be applied in any situation where full length compartments are to be stabilized without sacrificing weight or requiring additional metal structure for stability.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A golf bag divider structure comprising:

a divider portion having at least a plurality of outer edges;

an outer layer having a first end and a second end, a first width and a first length extending from said first end to said second end;

an inner looping layer of material having a second width greater than said first width and a second length such that periodic joinder of said inner looping layer to said outer layer along said first length of said outer layer and said second length of said inner looping layer to evenly fit said outer layer results in a plurality of evenly spaced full length pockets, the outer edges of said divider portion attached between different ones of said full length pockets of said inner looping layer, said outer layer and said inner looping layer formed into a tube shape; and an outer sleeve of rigid material also formed into a tube shape and having a first end and a second end and attached to said outer layer near said second end of said outer layer and near said second end of said outer sleeve to hold said outer layer in a stable configuration, said inner looping layer supported by said outer sleeve of rigid material through said outer layer's attachment to said sleeve of rigid material and said outer layer's support near said first end of said outer sleeve of rigid material.

2. The golf bag divider structure as recited in claim wherein said outer layer is attached to said inner looping layer of material by sewn connections.

3. The golf bag divider structure as recited in claim 1 further comprising an upper reinforcing collar attached to said outer layer.

4. The golf bag divider structure as recited in claim 3 wherein said collar further comprises:

a first area of material having a finished side and a second side and an upper edge;

a second area of relatively rigid material having an upper edge and attached to said first area of material near said upper edge of both said second area of relatively rigid material and said first area of material, said finished side of said first area of material facing said second area of material along said upper edge of both said second area of relatively rigid material and said first area of material, said first area of material folded over said upper edges and into said second area of material to expose said finished side, said first and said second areas of material formed into a circle, said second area of material attached to said first end of said outer layer.

5. The golf bag divider structure as recited in claim 4 wherein said first end of said outer layer is attached between said second area of material and said first area of material of said collar.

6. The golf bag divider structure as recited in claim 5 wherein said outer sleeve of rigid material has an upper bearing surface and wherein said second area of relatively rigid material has a lower bearing surface opposing and capable of bearing upon said upper bearing surface.

* * * * *